United States Patent [19]

Budzich

[11] Patent Number: 4,679,492

[45] Date of Patent: Jul. 14, 1987

[54] COMPENSATED FLUID FLOW CONTROL VALVE

[75] Inventor: Tadeusz Budzich, Moreland Hills, Ohio

[73] Assignee: Caterpillar Inc., Peoria, Ill.

[21] Appl. No.: 887,590

[22] Filed: Jul. 21, 1986

[51] Int. Cl.[4] ..... F15B 13/08

[52] U.S. Cl. ..... 91/420; 91/446; 137/596.1; 137/596.13

[58] Field of Search ..... 60/452; 91/420, 446; 137/596.1, 596.13

[56] References Cited

U.S. PATENT DOCUMENTS 3,744,517 7/1973 Budzich ..... 137/596.2

4,222,409 9/1980 Budzich ..... 137/596.13

4,487,018 12/1984 Budzich ..... 60/452

*Primary Examiner*—Gerald A. Michalsky

*Attorney, Agent, or Firm*—J. W. Burrows

[57] ABSTRACT

A compensated direction flow control valve assembly for control of fluid flow to and from a fluid motor, which may be of a cylinder type and is subjected to positive and negative loads. During control of negative load, the negative load compensating control varies the level of the pressure differential across a metering orifice, positioned at the outlet of the fluid motor, in response to pressure at the inlet of the fluid motor, while maintaining this pressure differential constant at each specific level. The pressure differential across a metering orifice, positioned at the inlet of the fluid motor, is maintained at a constant preselected level by the positive load compensator control assembly.

38 Claims, 4 Drawing Figures

W
41
42
43
44
11
39
40
28
10
26
24
25
27
17
18
19
32
30
31
34
33
23
20
37
21
35
36
38
22
29
15
87A
87
Ps
56A
51
55
52
60
59
57
47
63
46
62
67
72
48
73
66
48A
76
83
12
80
45
86
88
85
92
84
75
56
58
79
61
49
50
53
54
69
74
65
64
71
68
70
77
Pp
82
81
90
89
91
14
93
111
101
121
PN
110
Pp
94
123
100
96
101A
108
106
109
112
105
102
119
95
113
114
101A
120
97
13
98
122
117
118
116
115
16
99
107
103
104
14

41
43
42
44
W
11
128
24
25
127
126
34
23
125
124
31
148
$P_S$
147
12
55
52
51
49
46
47
67
69
142
141
140
145
86
45
85
84
58
57
79
54
71
53
74
143
144
146
82
83
80
88
89
91
14
152
154
100
155
151
$P_P$
94
121
$P_N$
95
112
103
119
114
118
96
150
97
13
120
134
137
136
138
98
99
153
149
151A
152A

COMPENSATED FLUID FLOW CONTROL VALVE

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system in which a plurality of loads is individually controlled under positive and negative load conditions by separate control valves.

In more particular aspects, this invention relates to direction and flow control valves capable of controlling simultaneously a number of loads, under both positive and negative load conditions.

In still more particular aspects, this invention relates to automatic synchronizing controls for synchronization of the compensating action of positive and negative load compensators, in controlling fluid flow in and out of fluid motors of a cylinder piston rod type.

In still more particular aspects, this invention relates to negative load compensating control of a compensated direction control valve, in which the negative load throttling action is responsive to the fluid motor inlet pressure, generated by the pump.

Closed center load responsive fluid control valves, of a fully compensated type, are very desirable for a number of reasons. They permit load control with reduced power loss and therefore, increased system efficiency and when controlling one load at a time provide the feature of flow control, irrespective of variation in the magnitude of the load. Such valves are provided with positive and negative load compensating controls, which automatically maintain a constant pressure differential and therefore constant flow characteristics, through the metering control orifices handling the flow in and out of the fluid motor. Such a fluid control valve is shown in FIG. 3 of my U.S. Pat. No. 3,744,517 issued July 10, 1973. However, such fully compensated control valves suffer from one basic disadvantage, when controlling fluid flow to and from an actuator, in the form of a cylinder, which, due to the well-known piston rod effect, is characterized by different flow rates between the in and out flows of the cylinder. Depending on the direction of actuation such cylinders, when controlled by the valve of U.S. Pat. No. 3,744,517, can be subjected either to cavitation, or excessive pressures, due to the energy derived from the pump circuit during control of negative load.

This drawback can be overcome in part by the provisions of the fully compensated proportional valves disclosed in my U.S. Pat. No. 4,222,409, issued Sept. 16, 1980. In this compensated control valve, during negative load control, the pump circuit is automatically isolated from the cylinder, preventing generation of excessive pressures, while the cavitation condition is prevented by fluid flow from pressurized exhaust manifold. This type of control, although very effective, suffers from one serious disadvantage in applications requiring high control stiffness and high frequency response. Those harmful characteristics result from the fact that the energy derived from the pump cannot be directly applied to both ends of the actuator, without going through the stage of isolating the actuator from the pump, during control of negative load. Therefore, such valves display some undesirable characteristics, when used as proportional, or servo valves, in servo systems controlling loads.

SUMMARY OF THE INVENTION

It is therefore a principal object of this invention to vary the control pressure differential of the negative load compensator, in response to the pressure developed at the metering orifice supplying the cylinder inlet, to prevent build-up of excessive pressures in the actuator, during control of negative load.

Another object of this invention is to synchronize the compensating action of the positive and negative load compensators, in control of all types of actuators, by variation in pressure differential across the negative load metering slots, while the pressure differential across the positive load metering slots remains constant at a preselected level.

It is a further object of this invention to provide a fully compensated direction control valve, for control of positive and negative load, which permits the use of positive and negative load compensation in control of cylinder type actuators, while making cavitation within the actuator impossible and automatically guarding against excessive pressures, developed in the actuator, especially during control of negative loads.

It is a further object of this invention to provide a synchronizing control of the action of the positive and negative load compensators, which automatically compensates for variation between the in and out flows of the actuator, while also compensating for the timing of the direction and flow control metering slots of the direction control spool, during control of both positive and negative loads.

It is a further object of this invention to provide a synchronizing control of the positive and negative load compensators, which during control of positive load automatically deactivates the negative load compensator, by maintaining it in a fully open position, resulting in minimum throttling loss and making interaction between individual compensators impossible.

It is a further object of this invention to limit, by the positive load compensator, the cylinder inlet pressure to a certain low pressure level, during control of negative load, to eliminate the possibility of cavitation, ensure high system efficiency and prevent generation of excessive pressures in the cylinder.

It is a further object of this invention to provide a synchronizing control of the positive and negative load compensators, in which the flow through the positive load metering slots becomes a dominant factor and always takes place at a constant pressure differential, during control of positive and negative load.

It is a still further object of this invention to provide a synchronizing control, which automatically varies, during control of negative load, the pressure differential of the negative load compensator to maintain the cylinder inlet pressure at a certain minimum relatively constant pressure level.

Briefly the foregoing and other additional objects and advantages of this invention are accomplished by providing a novel load responsive, fully compensated fluid control valve, in which, during control of negative load, the pressure at the positive load metering slot regulates the magnitude of the pressure differential of the negative load compensator, preventing not only an undesirable build-up of the negative load pressure, but also ensuring that the flow to the other end of the cylinder is supplied at a certain minimum positive pressure level, preventing any possibility of cavitation, compensating for different rates of flow in and out of the actuator and timing of the metering slots of the direction control spool, while also ensuring minimum pump loss, during control of negative load.

Additional objects of this invention will become apparent when referring to the preferred embodiments of this invention as shown in the accompanying drawings and described in the following detailed description.

DESCRIPTION OF THE PREFERRED EMBODIMENTS

Figure 1:
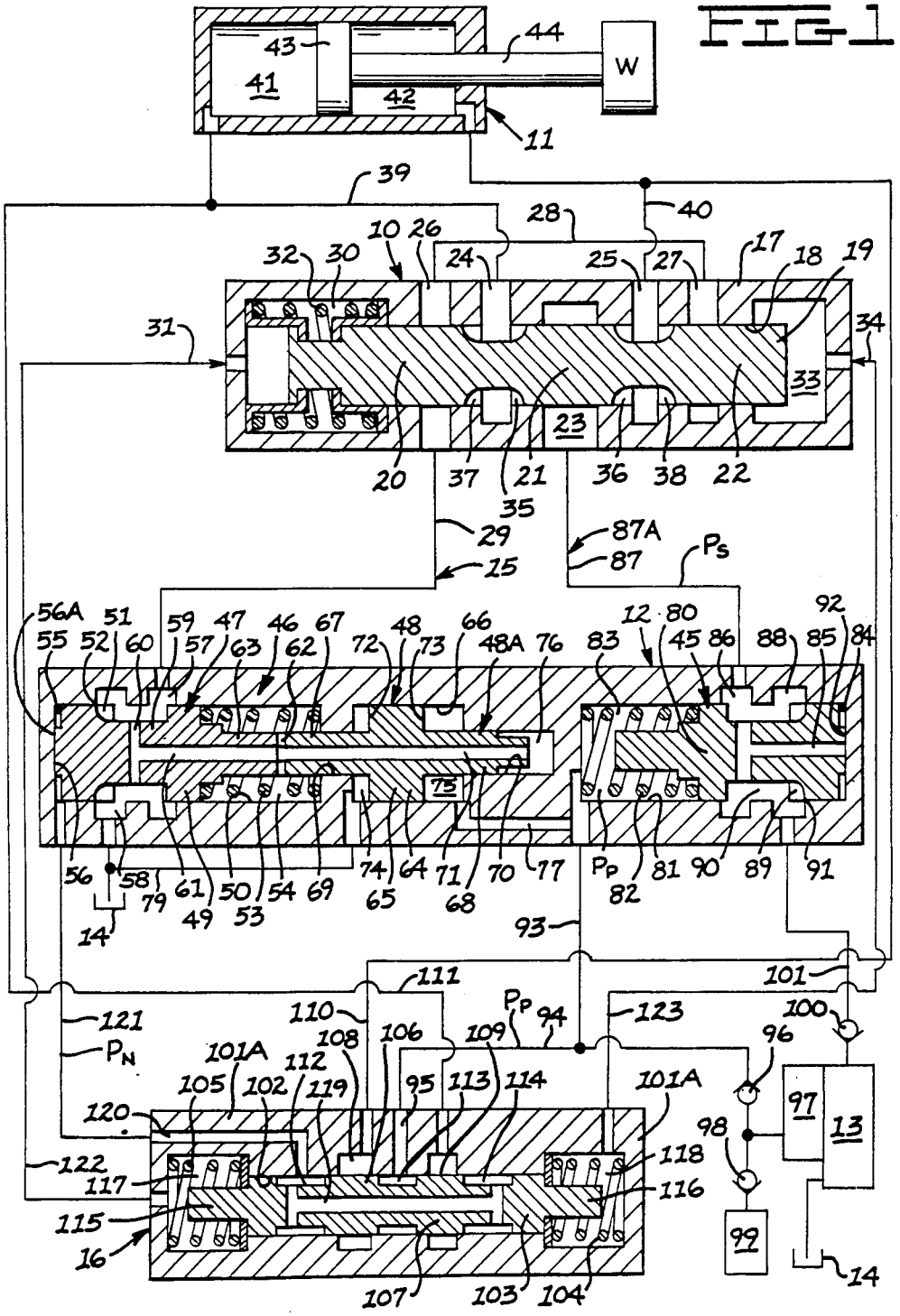
FIG. 1 is a longitudinal sectional view of an embodiment of a single stage compensated direction control valve responding to a hydraulic control signal, together with a sectional view of pressure compensated controls and a sectional view of load pressure signal identifying and transmitting valve, with schematically shown system pump, actuator in the form of a cylinder and system reservoir, all connected by schematically shown system fluid conducting lines.

Referring now to FIG. 1, an embodiment of a valve assembly having a first valve means such as a direction and flow control valve, generally designated as 10, is shown interposed between a fluid motor of a cylinder type, generally designated as 11 and a compensating control assembly, generally designated as 12 supplied with a source of fluid power from a pump 13 and connectd to reservoir means 14, which constitutes a part of a fluid exhaust means such as, an exhaust system generally designated as 15. A logic means, such as an external logic module generally designated as 16, is functionally interconnected to the flow control valve 10 and compensating control assembly 12 for identification and transmittal of load pressure signals.

The flow control valve 10 is of a four way type and has a housing 17 provided with a bore 18 axially guiding a valve spool means, such as, a valve spool 19. The valve spool 19 is provided with lands 20, 21 and 22, which in neutral position of valve spool 19, as shown in FIG. 1, isolate a fluid supply chamber 23, load chambers 24 and 25 and outlet chambers 26 and 27. The outlet chambers 26, 27 and connecting lines 28 and 29 form part of the exhaust system 15. The land 20 of the valve spool 19 protrudes into a control chamber 30 subjected to pressure of control signal 31 and engages a centering spring assembly 32, well-known in the art. The land 22 of the valve spool 19 protrudes into a control chamber 33, which is subjected to pressure of control signal 34. The lands 20, 21 and 22 of the valve spool 19 are provided with inflow, or positive load pressure metering slots 35 and 36 and with outflow, or negative load pressure metering slots 37 and 38. The metering slots 35,36 form a fluid inflow metering orifice means while the metering orifices 37,38 form a fluid outflow metering orifice means.

The load chambers 24 and 25 are connected by lines 39 and 40 with cylindrical spaces 41 and 42 of the fluid motor 11, which are separated by piston 43 connected by a piston rod 44 with load W.

The compensating control assembly 12 is equipped for compensation of both positive and negative loads and is provided with positive load pressure compensating control means, generally designated as 45, and a negative load pressure compensating control means, generally designated as 46, which is provided with a first regulating means, such as, a control of constant pressure differential, generally designated as 47, and a second regulating means, such as, a regulating control for adjustment of the constant pressure differential, generally designated as 48.

The control of constant pressure differential 47, operable during control of negative load, is provided with a throttling member means 49 axially slidable in bore 50, provided with throttling port means 51 provided with blocking edges 52, and biased by control spring 53, located in a second control chamber 54. One end of the throttling member 49 is subjected to pressure in a third control chamber 55 and in position as shown in FIG. 1 abuts against surface 56 and stop 56*a*, while an inlet chamber 57 and an exhaust chamber 58 are fully interconnected through annular space defined by bore 50 and stem 59, while the throttling slots 51 remain in a fully open non-throttling position. The cylindrical surface of the stem 59 is connected through passages 60 and 61 and slot 62 with the second control chamber 54. The throttling member 49 is provided with an extension 63 selectively engagable by the regulating control 48. The inlet chamber 57 is connected by line 29 with the exhaust system 15, while the exhaust chamber 58 is connected with the system reservoir 14.

The regulating control 48 is provided with a differential piston 64 having a land 65 slidably guided in bore 66 and first and second cylindrical extensions 67 and 68 of identical cross-sectional area guided in bores 69 and 70. The differential piston 64 is provided with a central passage 71, first and second force generating annular areas 72 and 73 and defines spaces 74, 75 and 76. Space 75 is connected by passage 77 with fourth control chamber 83 of the positive load pressure compensated control 45. Space 74 is connected by line 79 with the system reservoir 14. Space 76 is connected by the central passage 71 and slot 62 with the second control chamber 54. The annular area 73, space 75 and passage 77 collectively make up the force generating means.

The regulating control 48 is provided with a deactivating device, generally designated as 48*a*, of the control of constant pressure differential 47, which consists of a combination of the second force generating annular area 73, subjected to pressure in space 75 and the biasing force of the control spring 53. During control of positive load, those two forces, when combined, are greater than the force generated by pressure in the third control chamber 55, acting on the cross-sectional area of the throttling member 49, maintaining it in a fully open deactivated position, as shown in FIG. 1.

The positive load pressure compensated control 45 is provided with a fluid throttling means, such as, a throttling member 80, guided in a bore 81, biased by control spring 82 and subjected on its cross-sectional area to the pressure Pp in the fourth control chamber 83 and pressure Ps. on the fifth control chamber 84. The fifth control chamber 84 is connected by a passage 85 with the second fluid supply chamber 86, which in turn is connected by line 87 with the fluid supply chamber 23. The inlet chamber 88 is functionally interconnected through fluid throttling slot means, such as, positive load throttling slots 89 and annular space 90 with the second fluid suppply chamber 86. The positive load throttling slots 89 are provided with cut-off edges 91. The end of the throttling member 80, protruding into the fifth control chamber 84, abuts against surface 92 in a non-throttling position as shown in FIG. 1. The fourth control chamber 83 is connected by lines 93 and 94 with a positive load signal port 95 of the external logic module, generally designated as 16. The positive load signal port 95 is also connected through line 94 and check valve 96 with an output flow control or load responsive control 97 of the pump 13. The check valve 98, in a well-known manner, connects the positive load pressure signals to the load responsive control 97 from schematically shown load sensing system 99. The pump 13 is connected by load check 100 and line 101 to the inlet chamber 88. The positive load signal port 95, line 94 and line 93 make up a first transmitting means while the positive load signal port 95, line 94 and check valve 96 make up a second transmitting means.

A positive load pressure control 87*a* may be of a form, in which the pressure from the pump 13, provided with the load responsive control 97, is dirctly throttled in the inflow metering slots 35 and 36, or may be in the form, in which, a positive load pressure compensated control, generally designated as 45, is interposed between the pump 13 and the inflow metering slot 35 or 36.

The external logic module 16 has a housing 101*a*, provided with a bore 102, slidably guiding load pressure identifying shuttle 103, biased by springs 104 and 105, towards neutral positon, as shown in FIG. 1, in which lands 106 and 107 isolate chambers 108 and 109. The chamber 108 is connected by line 110 with cylindrical space 42. The chamber 109 is connected by line 111 with the cylindrical space 41. The load pressure identifying shuttle 103 defines annular spaces 112, 113 and 114 and protrudes with its ends 115 and 116 into chambers 117 and 118. The annular spaces 112 and 114 are connected through central passage 119 and passage 120 with line 121 connected to the third control chamber 55 and transmits identified negative load pressure Pn. The passage 120 and line 121 make up a third transmitting means. The chamber 117 is connected by line 122 with the control chamber 30. The chamber 118 is connected by line 123 with control chamber 33. From annular space 113 and positive load signal port 95, the identified positive load pressure signal, at positive load pressure Pp, is transmitted through line 94 to the fourth control chamber 83. The shuttle 103 makes up a means operable to identify the presence of a positive and/or a negative load pressure.

Figure 2:
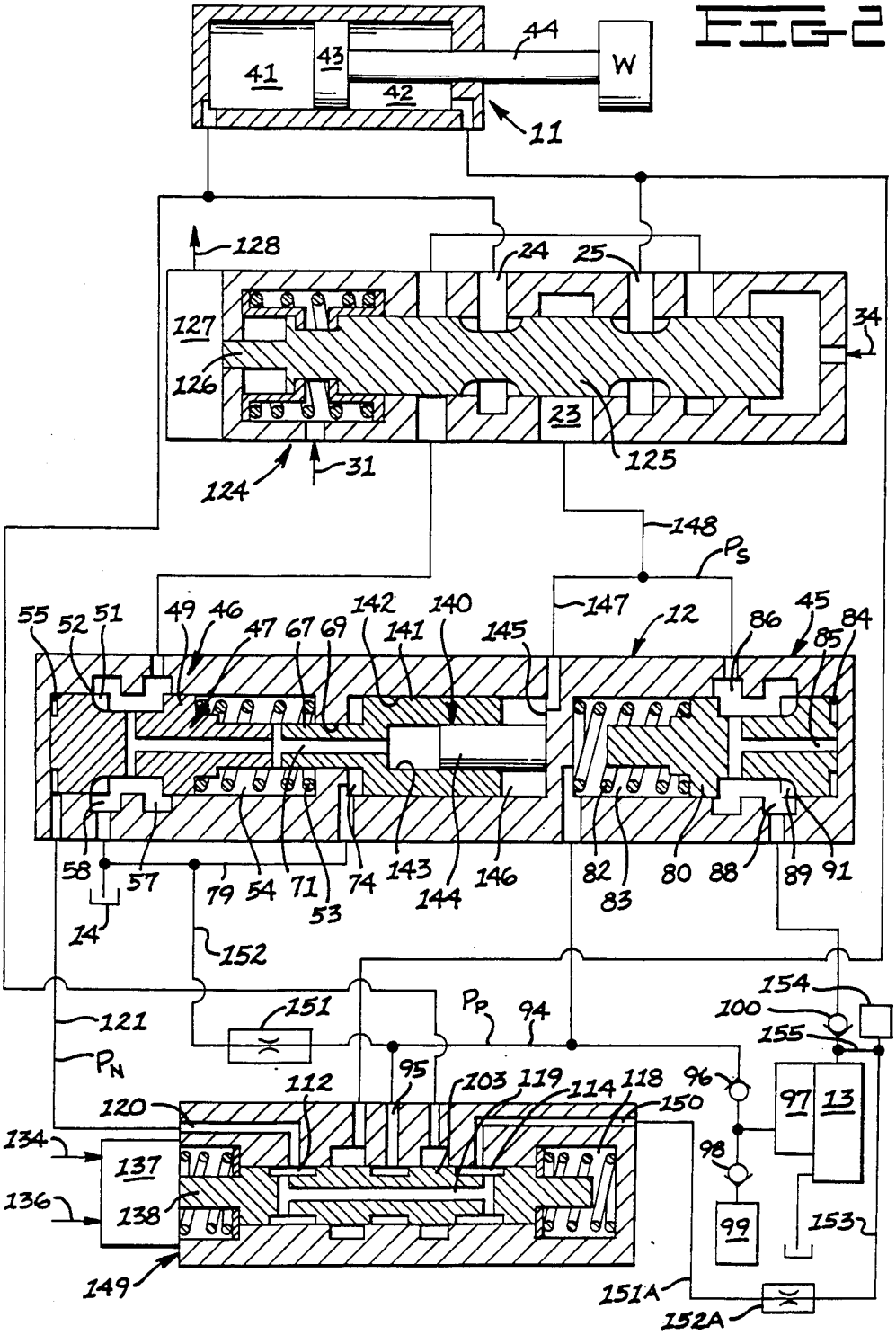
FIG. 2 is a longitudinal sectional view of an embodiment of a single stage compensated direction control valve, together with a sectional view of pressure compensated controls and a sectional view of a load pressure signal identifying and transmitting valve with schematically shown compensator energizing controls, the electro-hydraulic spool actuating controls, system pump, actuator in the form of a cylinder and system reservoir, all connected by schematically shown system fluid conducting lines.

Referring now to FIG. 2, the fluid power and control circuit of FIG. 2 and its basic control components are very similar to those of FIG. 1 and like components of FIGS. 1 and 2 are designated by like numerals.

The direction and flow control valve, generally designated as 124, is very similar to the direction and flow control valve 10 of FIG. 1, with one exception being that the direction control spool 125 of FIG. 2 is connected by extension 126 to a spool position transducer 127, which generates an electrical position control signal 128, proportional to the position of the direction control spool. Control signals 134 and 136 which are generated in response to the positive or negative sign of the position control signal 128 or by the existence of a pressure signal in control signal 31 or control signal 34, are transmitted to a bidirectional solenoid 137, mounted on an electrically operated external logic module 149, which through an extension 183, displaces the load pressure identifying shuttle 103 in the appropriate direction through its entire stroke. The positive or negative sign of the position control signal 128 indicates the direction of the displacement of the control spool 125. A second regulating means, such as, a regulating control generally designated as 140, which is a part of a compensated control assembly 12 is very similar in its basic principle of operation to the regulating control 48 of FIG. 1. A piston 141, slidably guided in a bore 142, is provided with a bore 143, slidably guiding a balancing piston 144, which selectively engages reaction surface 145. The balancing piston 144 protrudes into a control chamber 146, which is connected by lines 147 and 148 to the fluid supply chamber 23 and to a second fluid supply chamber 86, of the positive load pressure compensated control 45. The piston 141, control chamber 146, and lines 147,148 make up the force generating means in FIG. 2.

The positive load signal port 95, of external logic module 149, is connectd by line 94 to a compensation energizing means, such as, a leakage control 151, which in turn is connected through lines 152 and 79 to the system reservoir 14.

The negative load sensing circuit of the external logic module 149 is connected through passage 150 and line 151*a* with another compensation energizing means, such as, an energizing control 152*a*, which in turn is connected by line 153 with a source of pressure 154. The source of pressure 154 may be self-contained or may be connected, as shown in FIG. 2, by line 155 with the discharge port of the pump 13.

Figure 3:
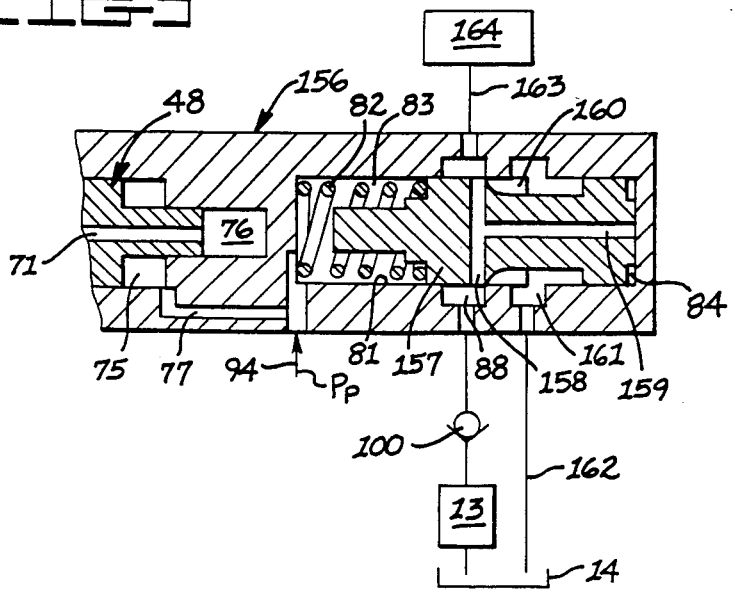
FIG. 3 is a partial sectional view of a positive load compensator of a bypass type with other system components shown schematically.

Referring now to FIG. 3, a partial section of the positive load pressure compensating control means, such as, the compensating control assembly generally designated as 156, is very similar to the compensated control assembly 12 of FIG. 1 and includes identical regulating control 48 and the control of pressure differential 47 (FIG. 1), used in the control of negative load. The pump 13, through the load check 100, is connected to the inlet chamber 88. The throttling and bypass member 157, guided in bore 81 towards position as shown, is biased by the control spring 82, positioned in the fourth control chamber 83. The inlet chamber 88 is connected by drillings 158 and 159 with the fifth control chamber 84. Fluid bypass slot means, such as, throttling and bypass slots 160 are positioned between the inlet chamber 88 and an exhaust chamber 161, which is connected by line 162 to the system reservoir 14. The inlet chamber 88 is connected by line 163 to schematically shown direction control valve assembly 164, which can be identical to the direction and flow control valve 10 of FIG. 1, or the direction and flow control valve 124 of FIG. 2.

Figure 4:
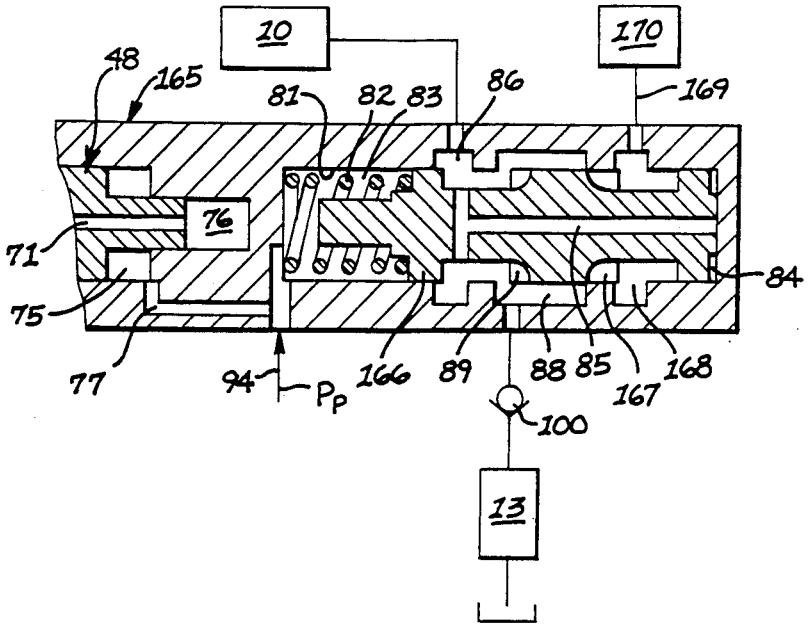
FIG. 4 is a partial sectional view of a positive load compensator of a throttling and bypass type, for use in series type circuits, with series type circuit and other system components shown schematically.

Referring now to FIG. 4, a partial section of the positive load pressure compensating control means, such as, the compensating control assembly, generally designated as 165, is very similar to the compensator control assembly of FIG. 1 and includes the identical regulating control 48 and the control pressure differential 47 (FIG. 1), used in control of negative load. Fluid throttling means, such as, a throttling and bypass member 166 is provided with the positive load throttling slots 89 and fluid bypass slot means, such as, the bypass throttling slots 167. The bypass and throttling slots 167 are positioned between the inlet chamber 88 and a bypass chamber 168, which is connected by line 169 to a downstream series power circuit 170, well-known in the art.

Referring now back to FIG. 1, the fluid motor 11 is of a cylinder type and is coupled, through the piston rod 44, to the load W, which may be of an opposing or positive, or an aiding or negative type. The fluid flow to and from the fluid motor 11 is controlled by a direction and flow control valve, generally designated as 10, which has its load chambers 24 and 25 connected by lines 39 and 40 to cylindrical spaces 41 and 42 of the fluid motor 11. In a well-known manner, the displacement of the valve spool 19, in either direction from its neutral position, as shown in FIG. 1, will connect the load chambers 24 and 25 with either the fluid supply chamber 23, or outlet chambers 26 and 27, which are connected by line 87 to the souce of pressure fluid and through lines 28 and 29 to the exhaust system.

The valve spool 19 is biased towards its neutral position as shown in FIG. 1, by the centering spring assembly 32, the preload of which determines the pressure level, necessary to displace the valve spool 19 from its neutral position. Any increase in the pressure level, in control chambers 30 and 33 above that, equivalent to the preload of the centering spring assembly 32, will, in a well-known manner, displace the valve spool 19 in either direction, the displacement of the valve spool 19 being directly proportional to the pressure of control pressure signal 31 or 34, which is generated by the spool position control system, not shown. During displacement of the valve spool 19, from its neutral position in either direction, the fluid, subjected to the pressure in the supply chamber 23, will be throttled by the inflow or positive load pressure metering slots 35 or 36, on its way to the load chamber 24 or 25 and on the way to the inlet of the fluid motor 11, while the fluid from the outlet of the fluid motor 11 connected with the load chamber 24 or 25, will be throttled, on its way to the outlet chamber 26 or 27, by the outflow or negative load pressure metering slots 37 or 38.

The identification of whether, during the control of the load W, the load chamber 24 or 25 is subjected to positive or negative load pressure, is accomplished by external logic module, generally designated as 16. The direction of the load W will determine whether the load chamber 24 or 25 is subjected to load pressure. The desired direction of displacement of the load W, in respect to the direction of its force, will establish whether the load W, being controlled at an instant, is of a positive or opposing type, or of a negative or aiding type. Therefore, for any specific direction of the force, developed by the load W, generation of the control pressure signal 31 or 34 will automatically establish the characteristics of the load. The control pressure signal 31 or 34 is transmitted through lines 122 and 123 to the chamber 117 or 118, causing full displacement, in either direction of the load pressure identifying shuttle 103. The preload of the springs 104 and 105 is so selected that full displacement of the load pressure identifying shuttle 103 will take place before the valve spool 19, biased towards neutral position by the centering spring assembly 32, is displaced, providing the so-called feature of anticipation. The displacement of the load pressure identifying shuttle 103 will connect the chamber 108 or 109 to the positive load signal port 95, while also connecting the chamber 108 or 109 to passage 120, which is part of the negative load pressure transmitting circuit. Since chambers 108 and 109 are connected by lines 110 and 111 with the cylindrical spaces 42 and 41 of the fluid motor 11, the presence of either positive or negative load pressure will be identified by the external logic module 16, with either positive load pressure Pp, existing in positive load signal port 95, or negative load pressure Pn, existing in the passage 120. Therefore, the load pressure is identified as positive or negative by the external logic module 16 and transmitted to the compensating control assembly 12.

The positive load pressure signal, during control of positive load, is transmitted from the positive load signal port 95, through lines 94 and 93 to the fourth control chamber 83 of the positive load pressure compensated control, generally designated as 45, which, in a well-known manner, will throttle, by positive load throttling slots 89, the fluid flowing from the inlet chamber 88, connected to the pump 13, to the second fluid supply chamber 86, which in turn is connected by line 87 with the fluid supply chamber 23, to maintain a relatively constant pressure differential across the inflow or positive load pressure metering slots 35 or 36. In this way, in a well-known manner, through the action of the positive load compensating control 45, with the constant pressure differential automatically maintained between the supply chamber 23 and the load chamber 24 or 25 the flow through the inflow or positive load metering slots 35 or 36 will be directly proportional to the displacement of the valve spool 19 from its neutral position, irrespective of the magnitude of the positive load W.

The negative load pressure signal, during control of negative load, is transmitted from the passage 120 and line 121 to the third control chamber 55. In a well-known manner, the control of the constant pressure differential, generally designated as 47, will throttle, by the throttling slots 51, the fluid flow from the inlet chamber 57 to the exhaust chamber 58, to maintain a constant pressure differential between the load chamber 24 or 25 and the outlet chamber 26 or 27. Therefore, the flow of fluid through the outflow or negative load metering slots 37 or 38, during control of negative load, always takes place at a constant pressure differential, making this flow proportional to the displacement of the valve spool 19 from its neutral position, irrespective of the variation in magnitude of the negative load W.

During control of negative load, as already described, the flow of fluid from the fluid motor 11 is automatically controlled by the negative load pressure compensated control 46 in such a way that it is always proportional to the effective flow areas of the outflow or negative load pressure metering slots 37 or 38. The outflowing fluid from the fluid motor 11, during control of negative load, from one side of the fluid motor must take place, while the required quantity of fluid is supplied from the pump circuit to the other, or inflow side of the fluid motor 11. In a well-known manner, the outflow of the fluid motor of a cylinder type is different from the equivalent required inflow, by the volume caused by the displacement of the piston rod 44. Therefore, for any specific displacement of the valve spool 19, flow at different levels will take place through the inflow or positive load pressure metering slots 35 and 36 and through the outflow or negative load pressure metering slots 37 or 38. Since, as described above, the positive and negative load compensating controls of the compensating control assembly 12 automatically maintain a constant pressure differential across the inflow and outflow metering slots of the valve spool 19, trying to maintain the fluid inflow to the fluid motor 11 equal to the fluid outflow from the fluid motor 11 and since, as already described above, with the fluid motor 11 being of a cylinder type, the inflow and outflow are different, the following parasitic effects will occur during control of negative load.

If the cylindrical space 41 of the fluid motor 11 is subjected to negtive load pressure, the outflow from the fluid motor 11 will be greater than the equivalent required inflow to cylindrical space 42, and, in a well known-manner, the pressure in the cylindrical space 42 will rise to the maximum level, in turn proportionally increasing the negative load pressure Pn in cylindrical space 41, using the energy derived from the pump circuit and will result in not only a very inefficient operation, but in the fluid motor 11 being subjected to excessive pressures.

If the cylindrical space 42, of the fluid motor 11, is subjected to negative load pressure, the outflow from the fluid motor 11 will be smaller than the equivalent inflow and, in a well-known manner, the pressure of the cylindrical space 41 will drop below atmospheric and the inlet of the fluid motor 11 will be subjected to cavitation.

In the embodiment of the compensating control assembly 12 of FIG. 1, the regulating control, generally designated as 48, is provided in order to synchronize the control action of the negative load pressure compensated control 46, with the control action of the positive load pressure compensated control 45, irrespective of whether the cylindrical space 41 or 42 of the fluid motor 11 is subjected to negative load pressure, the other cylindrical space of the fluid motor 11 cannot be subjected to either excessive positive load pressures or to the cavitation condition.

The synchronizing action between the positive and negative load compensators 45 and 46, through the use of regulating control 48, is accomplished in the following manner. During control of negative load, the control of pressure differential 47, as described above, automatically maintains the constant pressure differential, equivalent to the preload of the control spring 53 across the outflow of negative load pressure metering slots 37 or 38. The biasing force, transmitted to the throttling member 49 by the control spring 53, which automatically determines the level of the controlled pressure differential of the negative load pressure compensated control 46, is supplemented by the force, transmitted from the differential piston 64 of the regulating control 48, thus, automatically changing the level of the control pressure differential of the negative load pressure compensated control 46 and therefore the level of the controlled pressure differential acting across the outflow or negative load pressure metering slots 37 and 38. Since the cross-sectional areas of the first cylindrical extension 67 and second cylindrical extension 68 are identical and since the pressure in space 76, due to central passage 71, is identical to the pressure in the second control chamber 54, the effect of the pressure changes, due to the change in the magnitude of the negative load on the differential piston 64, are completely balanced. Therefore, the net force, generated on the differential piston 64 and transmitted to the throttling member 49, is equal to the difference between the forces developed on the first and second force generating annular areas 72 and 73, by pressures in space 74 and space 75. Since space 74 is connected by line 79 to system reservoir and since space 75, through passage 77, is subjected to positive load, or fluid inflow pressure at the fluid motor 11, which is supplied to fourth control chamber 83 by the external logic module 16, the differential piston 64 will always transmit to the throttling member 49 a force proportional to the inlet pressure at the fluid motor 11 and equal to the product of this inlet pressure and the second force generating annular area 73. In this way, during control of negative load, the pressure differential, controlled by the negative load compensated control 46, will proportionally increase with the increase of the inlet pressure in fluid supplied to the fluid motor 11, in turn increasng the flow at negative load pressure through the outflow, or negative load pressure metering slots 37 or 38. In this way the flow through the outflow, or negative load pressure metering slots 37 or 38 becomes a function of the inlet pressure of the fluid motor 11, this inlet pressure automatically seeking an equilibrium condition, at which the quantity of fluid, supplied to the fluid motor 11 through the inflow or positive load pressure metering slots 35 or 36, at a constant pressure differential controlled by the positive load compensating control 45 and equivalent to preload of the control spring 82, will produce an equivalent flow out of the fluid motor 11, through the outflow or negative load pressure metering slots 37 or 38, at an increased level of controlled pressure differential, acting across those metering slots. This synchronizing and flow equilibrium seeking action, between the compensating controls of the positive and negative load compensators, is made possible by making the level of the pressure differential, of the negative load compensator, responsive to the actuator inlet pressure, so that this level of the controlled pressure differential can be varied in response to the increase in the inlet pressure of the fluid motor 11, while it is automatically maintained constant, at each specific level, as determined by the actuator's inlet pressure. Therefore, through adjustment in the level of the controlled pressure differential of the negative load compensator 46, not only the automatic equilibrium condition between the inlet and outlet actuator flow is established, which automatically compensates for the difference between inlet and outlet actuator flows, as developed in the actuator in the form of a cylinder, but also the variation, due to manufacturing tolerances in the flow areas of the positive and negative load metering slots 35, 36, 37 and 38, is automatically compensated for, while also eliminating all of the parasitic effects, due to variation in timing of the valve spool 19.

The flow areas of the inflow or positive load pressure metering slots 35 or 36 are so established, that they can supply enough fluid flow into the fluid motor 11, at the constant pressure differential, controlled by the positive load compensator 45, so that the cavitation condition, in cylindrical spaces 41 and 42, can never take place. Then the equivalent outlet flows from the fluid motor 11 are automatically controlled by variation in the pressure differential, developed across the outflow or negative load pressure metering slots 37 or 38, in response to the pressure at the actuator inlet, so that the actuator inlet pressure, during control of negative load, cannot exceed a certain maximum predetermined value, which is independent of the magnitude of the negative load being controlled. As a result of this specific control feature, induced by the action of the regulating control 48, the controlled flow through the inflow or positive load pressure metering slots 35 or 36, by the positive load compensating control 45, becomes a dominant factor and automatically establishes and controls the velocity of the negative load W.

The regulating control is provided with a deactivating device, generally designated as 48*a*, which becomes effective during control of positive load and automatically maintains the throttling member 49 in a position, as shown in FIG. 1, providing maximum flow area and therefore minimum throttling loss between the inlet chamber 57 and exhaust chamber 58. The deactivating device 48*a*, due to the presence of the force developed on the second force generating annular area 73 by the positive load pressure and transmitted through first cylindrical extension 67 to the extension 63 of the throttling member 49, forcibly maintains the throttling member 49 against the surface 56 in its fully open, deactivated position.

Referring now back to FIG. 2, the fluid power and control circuit of FIG. 2 and its basic control components are very similar to those of FIG. 1.

The direction and flow control valve, generally designated as 124, is very similar to the direction and flow control valve 12 of FIG. 1 and meters in an identical way, through identical metering slots, the fluid flow between identical valve chambers. However, in FIG. 2 the spool 125 of direction and flow control valve 124 is connected by extension 126 to the spool position transducer 127, well-known in the art, which generates an electrical signal 128, proportional to the position of the direction control spool, which is determined by the magnitude of the control pressure signals 31 and 34. Control signals 134 and 136 as generated by the position control signal 128 are transmitted to the bidirectional solenoid 137, which through extension 138, displaces the load pressure identifying shuttle 103 in the appropriate direction through its entire stroke. In this way, in a manner similar to that as described when referring to FIG. 1, the electrically operated external logic module 149 identifies and transmits the positive and negative load pressure signals to the positive and negative load compensating controls 45 and 46.

The regulating control, generally designated as 140, is very similar in its basic principle of operation to the regulating control 48 of FIG. 1. The cross-sectional area of the balancing piston 144 is made identical to the cross-sectional area of the cylindrical extension 67 and due to central passage 71 is subjected to the identical pressure in the second control chamber 54, which pressure, during control of negative load, varies with the magnitude of the negative load. With the cross-sectional area of balancing piston 144 subjected to the negative load pressure, the balancing piston 144, abuts against the reaction surface 145, in which position the piston 141 is not subjected to any forces due to the pressure in the second control chamber 54. Then, under those conditions, the force, developed by the pressure differential between control chamber 146 and space 74, acting on the effective cross-sectional area of the piston 141, will be directly transmitted, through the extension 67, to the throttling member 49 of the negative load compensator 46. Since space 74 is connected by line 79 to the system reservoir 14 and since the control chamber 146 is connected by lines 148 and 147 to the second fluid supply chamber 86, subjected to Ps pressure, the force transmitted to the throttling member 49 will equal the product of the effective cross-sectional area of the piston 141 and Ps pressure. The Ps pressure, due to the action of the positive load compensator 45, will always be higher, by a constant pressure differential, equivalent to the preload in the control spring 82, than the positive load pressure Pp. Since, as described above, Ps pressure is related to Pp pressure the effective force, transmitted from the regulating control 140 to the throttling member 49, will be related to the inlet pressure of the fluid motor 11. In this way, in a manner similar to that as described when referring to FIG. 1, the level of the controlled pressure differential of the negative load compensating control 46, is made responsive to Ps pressure, which in turn is related to Pp pressure, which is the pressure at the inlet of the actuator 11 during control of negative load.

The control chamber 146 of FIG. 2, instead of being connected to Ps pressure, can be directly connected to Pp pressure, existing in fourth control chamber 83. With this type of connection, the performance of the negative load compensating and synchronizing control of FIG. 2 becomes identical to that of FIG. 1, during control of negative load. With the control chamber 146 subjected to Ps pressure, the basic compensating action of the negative load compensator 46 will still be responsive to the inlet pressure of the fluid motor 11, but at a level higher by the value of the control pressure differential of the positive load compensator 45. Therefore, the compensating and control action of the positive load compensating and synchronizing controls of FIG. 2 will be very similar to that, as described when referring to FIG. 1, except that the force transmitting action of the regulating control 140 will be substantially faster, since the energy to actuate the regulating control 140 is not transmitted through the network of the external logic 149, but is transmitted from the pump 13.

The regulating control 140 of FIG. 2 in a very similar way, as the regulating control 48 of FIG. 1, is provided with a deactivating device, which completely deactivates the negative load compensating control, by maintaining the throttling member 49 in its fully open position as shown in FIG. 2, during control of positive load. As in the case with the control of FIG. 1, the force, developed on the effective area of piston 141 by Ps pressure, which during control of positive load is high, maintains the throttling member 49 in a fully open position, while the positive load compensator 45 is controlling a positive load.

With the control chamber 146 connected to positive load pressure Pp, as described above, the negative load compensating and synchronizing controls of FIG. 2, will provide identical control characteristics, as the equivalent controls of FIG. 1.

During control of positive load, the control chamber 146 and the balancing piston 144 are subjected to Ps pressure, which is much higher than the pressure in the second control chamber 54. Therefore, the balancing piston 144 will tend to leave the reaction surface 145 and a much higher force will be transmitted to the throttling member 49, maintaining it in a fully open position, as shown in FIG. 2. This higher force is generated, since in the embodiment of regulating control 140 of FIG. 2, the Ps pressure acts on the entire cross-sectional area of the piston 141, including the cross-sectional area of the balancing piston 144.

The use of the compenating control assembly 12, with its positive and negative load compensating controls 45 and 46, controls the pressure differential, acting across the metering orifices of the spool of the direction and flow control valve 124, in turn reducing the flow forces acting on the spool. Therefore, under those conditions, the control action of the direction and flow control valve 124 is not influenced by the magnitude of the load pressure and therefore lends itself well to servo valve applications, requiring exact control of flow to and from the fluid motor 11, while providing a high frequency response. Especially in servo systems positioning a tool, very small corrections in the tool position may be required, those small corrections requiring small displacements of the spool of the direction and flow control valve 124. Under those conditions, it is preferable to maintain the positive load compensating control 45 and the negative load compensating control 46 in positions regulating minimum flows and therefore with positive throttling slots 89 and negative load throttling slots 51 partially or fully closed. With the valve spool of the direction and flow control valve 124 in neutral position, no load pressure signals are transmitted from the external logic module 149 and the throttling members 80 and 49 of the compensating controls 45 and 46, subjected to the biaisng forces of the springs 82 and 53, move into their fully open minimum throttling position.

With the direction and flow control valve 124 in its neutral position and the load pressure identifying shuttle 103 centrally located, as shown in FIG. 2, the fourth control chamber 83 becomes isolated. The leakage control 151 is provided and it interconnects, for small fluid flows, the fourth control chamber 83 with the reservoir 14, through lines 94, 152 and 79. the leakage control 151 can be of a simple orifice type, the flow through which will vary with the positive load pressure Pp, or can be of a compensated flow control type, well-known in the art, which will provide a constant leakage from the fourth control chamber 83, irrespective of the magnitude of te load pressure Pp. The leakage control 151 automatically ensures that, in standby conditions, the pressure in the fourth control chamber 83 will be the same as reservoir pressure and the throttling member 80 will be fully displaced to the left, from the position as shown in FIG. 2, isolating, with its cut-off edges 91, the inlet chamber 88 from the second fluid supply chamber 86. In this standby position, the throttling member 80, with minimal displacement, is capable of throttling fluid flows at very small flow levels, increasing the frequency response of the control, for small corrections in position of the load W. With the load sensing circuit activated, the flow transmitting capacity of the positive load pressure signals, through the external logic module 149, is so large that the leakage flow, through the leakage control 151, becomes insignificant.

Similarly, with the direction and flow control valve 124 in neutral position and the load pressure identifying shuttle 103 centrally located, the third control chamber 55 becomes isolated and the throttling member 49, under biasing force of the spring 53, will drift towards fully open position, as shown in FIG. 2. Although the negative load sensing circuit is isolated from the load chamber 24 and 25, it is still connected with the source of pressure 154, through line 153, the energizing control **152*a*, line 151*a* and passage 150. The energizing control of 152*a* may be of identical construction as that of leakage control 151 and transmits fluid flow, at a very small level, to the negative load sensing circuit. With the pressure from the source of pressure 154 being high enough to compress the spring 53 in standby position, the throttling member 49 is maintained in a closed position, with the blocking edges 52 isolating the inlet chamber 57 from the exhaust chamber 58. With the load sensing circuit activated, the flow transmitting capacity of the negative load pressure signals through the external logic module 149 is so large, that the flow through the energizing control 152*a* becomes insignificant and does not affect the operation of the controls. Depending on the characteristics of the source of pressure 154, a conventional check valve may be interposed between the energizing control 152*a* and passage 150, to prevent reverse flow through the energizing control 152*a*. Therefore, the energizing control 152*a* ensures that in standby position the throttling member 49**, with minimal displacement is capable of throttling fluid flows at very small flow levels, increasing the frequency response of the control, for small corrections in position of the load W.

Referring now back to FIG. 3, the throttling and bypass member of the compensating control 156, in a well-known manner, maintains a constant pressure differential between the pressure in the inlet chamber 88 and the fourth control chamber 83, which is connected, through line 94, with the positive load identifying circuit of the external logic module 16 of FIG. 1 or 149 of FIG. 2. The level of this constant pressure differential is dictated by the preload in the control spring 82 and is controlled by the throttling action of the throttling and bypass slots 160, diverting the flow from the pump 13, which may be of a constant displacement type, to the exhaust chamber 161 and therefore to the system reservoir 14.

Referring now back to FIG. 4, the throttling and bypass member 166 of the compensating control 165, in a well-known manner, maintains a constant pressure differential between the second fluid supply chamber 86 and the fourth control chamber 83, which is supplied with fluid at positive load pressure through line 94 from the external logic module 16 of FIG. 1, or 149 of FIG. 2. The control of the pressure differential is obtained either through the throttling action of the positive load throttling slots 89, or through the bypass action of bypass and throttling slots 167. The bypass and throttling action of the bypass and throttling slots 167 permit the excess flow from the pump 13 to be passed to the bypass chamber 168, which is connected in series by line 169 with the series circuit 170. With the positive lod control of FIG. 4, the direction and flow control valve 10, connected to the second fluid supply chamber 86, has an automatic flow priority over the control valves of series circuit 170, since only the excess flow, over that required by the direction and flow control valve 10, can be passed to the series circuit 170.

The positive load controls of FIGS. 3 and 4 are integrated in an identical way with negative load compensating controls and regulating controls of FIGS. 1 and 2 and result in identical control characteristics of the control systems of FIGS. 1 and 2, since, through different actions, they still maintain the constant pressure differential, between the positive load pressure and the pressure upstream of positive load pressure metering slots.

Although the preferred embodiments of this invention have been shown and described in detail, it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. A valve assembly interposed between a fluid motor operable to control positive and negative loads and subjected to positive and negative load pressure, fluid exhaust means, including reservoir means and a source of pressure connected to a pump, first valve means operable to selectively interconnect said fluid motor with said exhaust means and said source of pressure, positive load pressure control means between said fluid motor and said pump, negative load pressure compensating control means between said fluid motor and said exhaust means, said negative load pressure compensating control means including fluid outflow metering orifice means, first regulating means of the throttling action of throttling member means operable to control the flow of fluid through any specific flow area of said fluid outflow metering orifice means at a relatively constant control pressure differential independent of the magnitude of said negative load pressure, and second regulating means operable to increase said control pressure differential acting across said fluid outflow metering orifice means with increase in pressure at said positive load pressure control means whereby fluid flow through said fluid outflow metering orifice means becomes independent of the magnitude of said negative load pressure and can be increased with the increase in pressure at said positive load pressure control means during control of said negative load.

2. A valve assembly, as set forth in claim 1, wherein said throttling member means of said first regulating means has throttling port means positioned downstream of said fluid outflow metering orifice means.

3. A valve assembly, as set forth in claim 1, wherein said positive load pressure control means includes fluid inflow metering orifice means.

4. A valve assembly, as set forth in claim 3, wherein said second regulating means has means responsive to pressure Pp downstream of said fluid inflow metering orifice means.

5. A valve assembly, as set forth in claim 3, wherein said second regulating means has means responsive to pressure Ps upstream of said fluid inflow metering orifice means.

6. A valve assembly, as set forth in claim 3, wherein said second regulating means has deactivating means of said negative load pressure compensating control means when pressure at said fluid inflow metering orifice means reaches a certain predetermined level.

7. A valve assembly, as set forth in claim 1, wherein said positive load pressure control means includes fluid inflow metering orifice means and positive load pressure compensating control means upstream of said fluid inflow metering orifice means operable to control the pressure differential across said fluid inflow metering orifice means at a relatively constant preselected level.

8. A valve assembly, as set forth in claim 7, wherein said positive load pressure control means includes compensation energizing means whereby said positive load pressure compensating control means is maintained in minimum flow throttling position in anticipation of positive load compensating action.

9. A valve assembly, as set forth in claim 1, wherein said positive load pressure control means includes fluid inflow metering orifice means, and positive load pressure compensating control means upstream of said inflow metering orifice means operable to control the pressure differential across said inflow metering orifice means at a relatively constant preselected level, said compensating control means having fluid bypass means operable to control bypass flow between said pump and said exhaust means.

10. A valve assembly, as set forth in claim 1, wherein said positive load pressure control means includes fluid inflow metering orifice means, and positive load pressure compensating control means upstream of said fluid inflow metering orifice means operable to control the pressure differential across said fluid inflow metering orifice means at a relatively constant preselected level, said positive load pressure compensating control means having fluid throttling slot means between said said pump and said fluid motor and bypass means between said fluid pump and a series power circuit.

11. A valve assembly, as set forth in claim 1, wherein logic means has means operable to identify the presence of said positive load pressure and first transmitting means operable to transmit control signal of said identified positive load pressure to said positive load pressure control means and to said second regulating means.

12. A valve assembly, as set forth in claim 10, wherein said pump has an output flow control responsive to said positive load pressure and said logic means has second transmitting means operable to transmit control signal of said identified positive load pressure to said output flow control of said pump.

13. A valve assembly, as set forth in claim 1, wherein logic means has means operable to identify the presence of said positive and said negative load pressure, first transmitting means operable to transmit control signal of said identified positive load pressure to said positive load pressure control means and said second regulating means, second transmitting means operable to transmit the control signal of said identified positive load pressure to said output flow control of said pump, and third transmitting means operable to transmit the control signal of said identified negative load pressure to said first regulating means.

14. A valve assembly, as set forth in claim 1, wherein said negative load pressure compensating control means includes compensation energizing means whereby said throttling member means is maintained in minimum flow throttling position in anticipation of negative load compensating action.

15. A valve assembly, as set forth in claim 1, wherein said first regulating means includes compensation energizing means whereby said first regulating means is maintained in minimum flow throttling position in anticipation of negative load compensating action.

16. A valve assembly interposed between a fluid motor operable to control positive and negative loads and subjected to positive and negative load pressure, fluid exhaust means and a source of pressure connected to a pump, first valve means operable to selectively interconnect said fluid motor with said exhaust means and said source of pressure, fluid inflow metering orifice means interposed between said fluid motor and said pump, positive load pressure compensating control means upstream of said fluid inflow metering orifice means operable to maintain by fluid throttling a relatively constant pressure differential across said fluid inflow metering orifice means, negative load pressure compensating control means between said fluid motor and said exhaust means, said negative load pressure compensating control means including fluid outflow metering orifice means, first regulating means of the throttling action of throttling member means operable to control the flow of fluid through any specific flow area of said fluid outflow metering orifice means at a relatively constant control pressure differential independent of the magnitude of said negative load pressure, and second regulating means having force generating means responsive to pressure at said fluid inflow metering orifice means operable to increase said control pressure differential acting across said fluid outflow metering orifice means with the increase in pressure at said fluid inflow metering orifice means whereby during control of negative load, a relatively constant pressure differential is maintained across said fluid inflow metering orifice means while the pressure level at said fluid inflow metering orifice means is limited to a certain maximum predetermined level.

17. A valve assembly, as set forth in claim 16, wherein said positive load pressure compensating control means includes fluid throttling means interposed between said pump and said fluid motor.

18. A valve assembly, as set forth in claim 16, wherein said positive load pressure compensating control means includes fluid bypass slot means interposed between said pump and said fluid exhaust means.

19. A valve assembly, as set forth in claim 16, wherein said positive load pressure compensating control means includes fluid throttling means interposed between said pump and said fluid motor and fluid bypass slot means interposed between said pump and a series power circuit.

20. A valve assembly supplied with pressure fluid by a pump and operable to control a fluid motor subjected to positive and negative load pressure, said valve assembly comprising a first valve means including a housing having a fluid supply chamber, first and second load chambers and fluid exhaust means connected to reservoir means, valve spool means for selectively interconnecting said load chambers with said supply chamber and said fluid exhaust means, fluid inflow metering orifice means responsive to movement of said valve spool means and operable to meter fluid flow between said fluid supply chamber and said load chambers and said fluid exhaust means, logic means operable to identify said positive and said negative load pressure and transmit a positive and negative load pressure signal, negative load pressure compensating control means responsive to said negative load pressure signal and operable to maintain a relatively constant second pressure differential across said fluid outflow metering orifice means at a relatively constant preselected level, and pressure regulating means operably connected to said negative load pressure compensating control means having force generating means responsive to pressure at said fluid inflow orifice means and operable to vary the level of said second pressure differential in response to pressure at said fluid inflow orifice means while said second pressure differential is maintained constant at each selected level by said negative load pressure compensating control means.

21. A valve assembly, as set forth in claim 20, wherein said force generating means of said pressure regulating means has reaction means responsive to pressure of said positive load pressure signal.

22. A valve assembly, as set forth in claim 20, wherein said force generating means of said pressure regulating means has reaction means responsive to pressure in said supply chamber upstream of said fluid inflow metering orifice means.

23. A valve assembly, as set forth in claim 20, wherein said force generating means has deactivating means operable to deactivate said negative load pressure compensating control means when pressure of said positive load pressure signal reaches a certain predetermined level.

24. A valve assembly, as set forth in claim 20, wherein positive load pressure compensating control means has fluid throttling member means responsive to said positive load pressure signal and operable to maintain a relatively constant first pressure differential across said fluid inflow metering orifice means.

25. A valve assembly, as set forth in claim 24, wherein said positive load fluid compensating means includes fluid throttling slot means interposed between said pump and said fluid motor.

26. A valve assembly, as set forth in claim 24, wherein said positive load pressure compensating fluid control means includes fluid bypass means interposed between said pump and said exhaust means.

27. A valve assembly, as set forth in claim 24, wherein said positive load positive compensating fluid control means includes fluid throttling slot means interposed between said pump and said fluid motor and fluid bypass means interposed between said pump and a series power circuit.

28. A valve assembly, as set forth in claim 24, wherein said positive load pressure compensating control means includes compensation energizing means whereby said positive load fluid throttling member means is maintained in a minimum flow throttling position in anticipation of positive load compensating action.

29. A valve assembly, as set forth in claim 20, wherein said negative load pressure compensating control means includes compensation energizing means whereby said negative load pressure fluid throttling member means is maintained in minimum flow throttling position in anticipation of negative load compensating action.

30. A valve assembly supplied with pressure fluid by a pump and operable to control a fluid motor subjected to positive and negative load pressure, said valve assembly comprising a first valve means including a housing having a fluid supply chamber, first and second load chambers and fluid exhaust means connected to resevoir means, valve spool means for selectively interconnecting said load chambers with said supply chamber and said fluid exhaust means, fluid inflow metering orifice means responsive to movement of said valve spool means and operable to meter fluid flow between said fluid supply chamber and said load chambers, fluid outflow metering orifice means responsive to movement of said spool valve means and operable to meter fluid flow between said load chambers and said fluid exhaust means, logic means operable to identify said positive and said negative load pressure and transmit a positive and negative load pressure signal, positive load pressure compensating control means responsive to said positive load pressure signal and operable to maintain a relatively constant first pressure differential across said fluid inflow metering orifice means, negative load pressure compensating control means responsive to said negative load pressure signal and operable to maintain a relatively constant second pressure differential across said fluid outflow metering orifice means at a relatively constant preselected level, and pressure differential regulating means operably connected to negative load pressure fluid throttling member means having force generating means responsive to pressure at said fluid inflow metering orifice means and operable to vary the level of said second pressure differential in response to pressure at said fluid inflow metering orifice means while said second pressure differential is maintained constant at each selected level by said negative load pressure compensating control means.

31. A valve assembly, as set forth in claim 30, wherein said positive load pressure compensating control means includes fluid throttling slot means interposed between said pump and said fluid motor.

32. A valve assembly, as set forth in claim 30, wherein said positive load pressure compensating control means includes fluid bypass means interposed between said pump and said exhaust means.

33. A valve assembly, as set forth in claim 30, werein said positive load pressure compensating control means includes fluid throttling slot means interposed between said pump and said fluid motor and fluid bypass means interposed between said pump and a series power circuit.

34. A valve assembly, as set forth in claim 30, wherein said force generating means of said pressure differential regulating means has reaction means responsive to pressure of said positive load pressure signal.

35. A valve assembly, as set forth in claim 30, wherein said force generating means of said pressure differential regulating means has reaction means responsive to pressure in said supply chamber upstream of said fluid inflow metering orifice means.

36. A valve assembly, as set forth in claim 30, wherein said force generating means has deactivating means operable to deactivate said negative load pressure compensating control means when pressure of said positive load pressure signal reaches a certain predetermined level.

37. A valve assembly, as set forth ih claim 30, wherein said negative load pressure compenLating control means includes compensation energizing means whereby said negative pressure load fluid throttling member means is maintained in minimum flow throttling position in anticipation of negative load compensating action.

38. A valve assembly, as set forth ih claim 30, wherein said positive load pressure compensating control means includes compensation energizing means whereby said positive load pressure fluid throttling member means is maintained in a minimum flow throttling position in anticipation of positive load compensating action.

* * * * *

UNITED STATES PATENT AND TRADEMARK OFFICE

CERTIFICATE OF CORRECTION

PATENT NO. : 4,679,492

DATED : July 14, 1987

INVENTOR(S) : Tadeusz Budzich

It is certified that error appears in the above-identified patent and that said Letters Patent are hereby corrected as shown below:

Column 16, line 30, after claim delete "10" and insert --11--.

Column 20, line 16, after forth delete "ih" and insert --in--.

Column 20, line 17, delete "compenLating" and insert --compensating--.

Signed and Sealed this

First Day of December, 1987

*Attest:*

*Attesting Officer*

DONALD J. QUIGG

*Commissioner of Patents and Trademarks*